US011156076B2

(12) United States Patent
Stokely et al.

(10) Patent No.: US 11,156,076 B2
(45) Date of Patent: Oct. 26, 2021

(54) DETACHABLE SENSOR WITH FIBER OPTICS FOR CEMENT PLUG

(71) Applicant: Halliburton Energy Services, Inc., Houston, TX (US)

(72) Inventors: Christopher Lee Stokely, Houston, TX (US); John Laureto Maida, Houston, TX (US); Krishna M. Ravi, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/754,041

(22) PCT Filed: Dec. 26, 2017

(86) PCT No.: PCT/US2017/068424

§ 371 (c)(1),
(2) Date: Apr. 6, 2020

(87) PCT Pub. No.: WO2019/132860

PCT Pub. Date: Jul. 4, 2019

(65) Prior Publication Data

US 2020/0240258 A1 Jul. 30, 2020

(51) Int. Cl.
*E21B 47/005* (2012.01)
*E21B 47/135* (2012.01)
(Continued)

(52) U.S. Cl.
CPC ..... *E21B 47/005* (2020.05); *E21B 33/16* (2013.01); *E21B 47/09* (2013.01); *E21B 47/135* (2020.05); *E21B 2200/08* (2020.05)

(58) Field of Classification Search
CPC ..... E21B 33/16; E21B 33/165; E21B 33/167; E21B 47/09–098; E21B 33/14; E21B 47/005
See application file for complete search history.

(56) References Cited

U.S. PATENT DOCUMENTS 6,634,425 B2 10/2003 King et al.
8,305,228 B2 11/2012 Vigneaux et al.
(Continued)

FOREIGN PATENT DOCUMENTS

| | | |
|---|---|---|
| EP | 2192263 | 6/2010 |
| WO | 2014099066 | 6/2014 |
| WO | 2016186612 | 11/2016 |

OTHER PUBLICATIONS

International Application No. PCT/US2017/068424, "International Search Report and Written Opinion", dated Sep. 7, 2018, 11 pages.

*Primary Examiner* — Kristyn A Hall
(74) *Attorney, Agent, or Firm* — Kilpatrick Townsend & Stockton LLP

(57) ABSTRACT

A sensor module can be used to make measurements during a single trip into and out of a wellbore in connection with a cement operation. The sensor module can include a detachment mechanism to detachably couple to a cement dart. The sensor module can also include a sensor to make measurements in a run-in-hole configuration prior to detaching from the cement dart and in a come-out-of-hole configuration subsequent to detaching from the cement dart in a wellbore. The sensor module can also include a transceiver to transmit the measurements to a processing device via a communication medium and to receive commands from the processing device via the communication medium.

19 Claims, 3 Drawing Sheets

(51) Int. Cl.
*E21B 33/16* (2006.01)
*E21B 47/09* (2012.01)

(56) References Cited

U.S. PATENT DOCUMENTS

| | | | | |
|---|---|---|---|---|
| 8,408,064 | B2 | 4/2013 | Hartog et al. | |
| 2004/0060697 | A1 | 4/2004 | Tilton et al. | |
| 2009/0229884 | A1 | 9/2009 | Pardey | |
| 2013/0021874 | A1 | 1/2013 | Hartog et al. | |
| 2014/0034301 | A1 | 2/2014 | Leblanc et al. | |
| 2014/0338886 | A1* | 11/2014 | Macrae | E21B 43/103 166/65.1 |
| 2016/0084075 | A1* | 3/2016 | Ingraham | E21B 23/01 166/255.1 |

* cited by examiner

DETACHABLE SENSOR WITH FIBER OPTICS FOR CEMENT PLUG

TECHNICAL FIELD

The present disclosure relates generally to systems and methods for completing a wellbore, and more specifically (although not necessarily exclusively), to systems and methods for tracking the location of a cementing tool and cement bond using fiber optic telemetry.

BACKGROUND

During completion of the wellbore, the annular space between the wellbore wall and a casing string (or casing) can be filled with cement. This process can be referred to as "cementing" the wellbore. A lower plug can be inserted into the casing string after which cement can be pumped into the casing string. An upper plug can be inserted into the wellbore after a desired amount of cement has been injected. The upper plug, the cement, and the lower plug can be forced downhole by injecting displacement fluid into the casing string. Variations in pressure of the displacement fluid can be used to determine the location of the upper plug, the cement, and the lower plug. These variations in pressure can be small and may not always be detected or may be incorrectly interpreted. Knowing the position of the upper plug, and thereby the cement below it, can prevent damage to the well or other errors in the cementing process. For example, variations in the pressure of the displacement fluid when the lower plug is trapped at an undesired location in the casing string can be incorrectly interpreted to mean the lower plug has reached its destination at a float collar at the bottom of the casing string. Knowing the location of the upper cement plug can increase the integrity of the well. And operators are often required to know the position of the top of the cement in the annulus.

DETAILED DESCRIPTION

Figure 1:
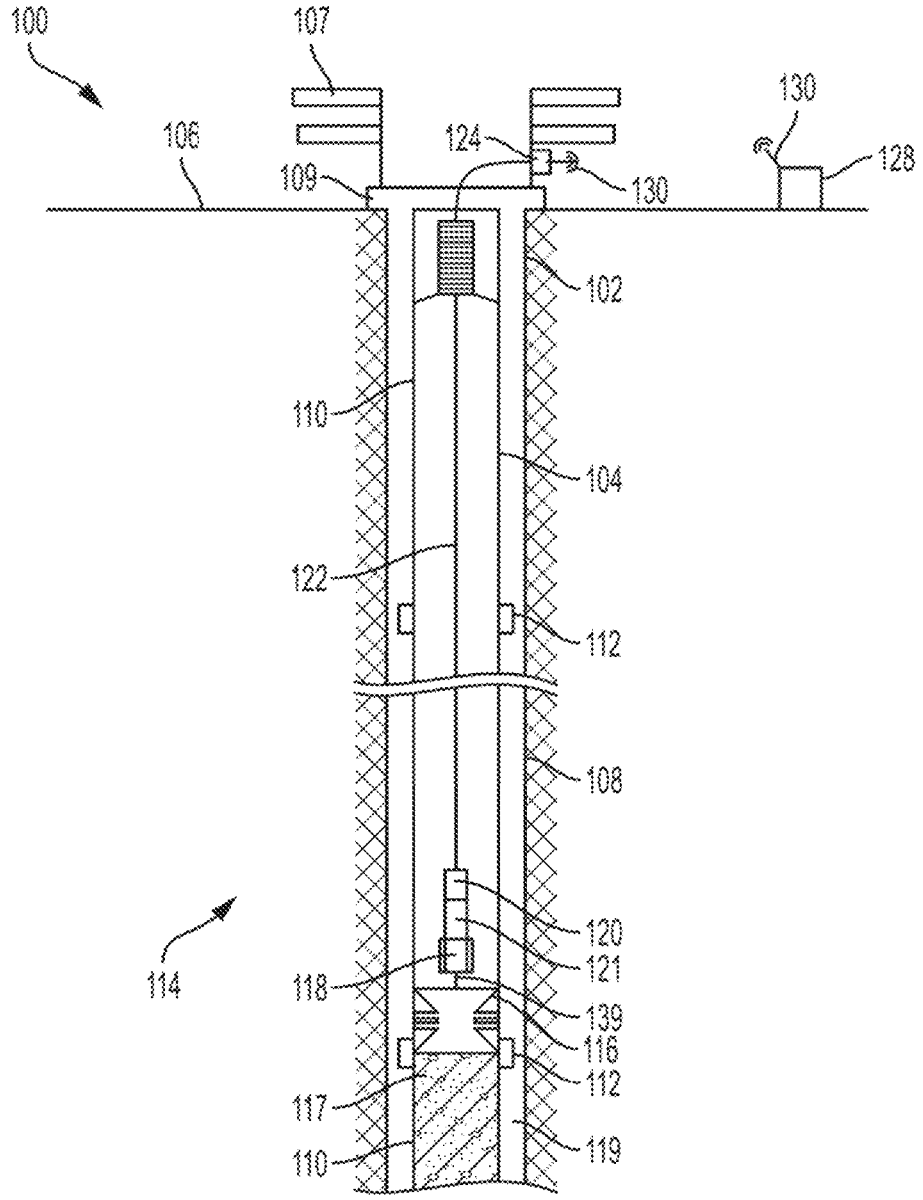
FIG. 1 is a schematic diagram of a well system for a sensor module to make measurements during a run-in-hole configuration in connection with a cementing operation according to one example of the present disclosure.

Certain aspects and features of the present disclosure relate to a system for using a fiber optic telemetry system during a cementing operation that can make measurements during a run-in phase, detach from a cement plug or dart, and make measurements during a pull-out phase to detect a position of the top of cement in an annulus. The wellbore can include a casing string that includes one or more casing collars. The cementing tool, for example a cement plug or a dart, can be positioned within the casing string. The cementing tool can be coupled to a sensor module via a lead. The sensor module can be, or include, a magnetic pickup coil that can detect a disturbance or change in a magnetic field, a piezoelectric sensor, a position sensor, and a cement bond locator. The sensor module can be coupled to a light source, for example a light emitting diode ("LED"). The voltage generated by the locator device can briefly energize the light source and cause the light source to emit a pulse of light.

The light source can be coupled to a fiber optic cable that can extend to the surface. The fiber optic cable can be dispensed on one or both ends by a bobbin or reel. The fiber optic cable can transmit the pulse of light to a processing device that includes a receiver, for example a photodetector, positioned at the surface. The receiver can detect the arrival of the pulse of light. In some aspects, the receiver can include a counter that can count the number of light pulses received as the locator device and the cementing tool travel downhole. The number of light pulses received by the receiver can correspond to the number of casing collars the locator device, and therefore the cementing tool, passed. The number of casing collars can indicate the position of the locator and cementing tool within the wellbore. In some aspects, the receiver can transmit information regarding the light pulses to a device located away from the wellbore surface.

The fiber optic cable can be dispensed (or unspooled) at one end by a reel (or bobbin) positioned proximate to the cementing tool. An additional reel can be positioned proximate to the surface of the wellbore and can also unspool additional lengths of the fiber optic cable. The reels can dispense the additional lengths of fiber optic cable in response to a tension in the fiber optic cable exceeding a pre-set value. The reels can prevent the fiber optic cable from breaking or otherwise becoming damaged as the cementing tool coupled to the fiber optic cable travels downhole.

In some aspects, additional sensors can be coupled to the fiber optic cable for monitoring various conditions within the wellbore. An additional sensor can include, but is not limited to, a temperature sensor, an acoustic sensor, a pressure sensor, a chemical sensor, an accelerometer, or other sensors for monitoring a condition within the wellbore. These sensors can transmit information about the wellbore conditions to the surface via the fiber optic cable.

Additional methods for monitoring the location of the cementing tool can also be utilized in conjunction with the systems and methods described herein. An additional method may include monitoring wellbore fluid pressure from the surface to determine when a cementing tool reaches a key location during cementing. For example, the wellbore fluid pressure can increase when the lower plug arrives at a float collar positioned at the bottom of the casing string. But, changes in the wellbore fluid pressure can be very small, just a few hundred pounds per square inch, and may be missed at the surface.

In one example, there is a passive cement wiper top dart with an attached sensor module, cable, and mechanical separator unit to allow for the separation of the dart from the sensor module and cable. The dart can be a top cement wiper plug used in a two-plug cement completion method (i.e., a method that includes a bottom dart at the bottom of a wellbore and a top dart to facilitate cement exiting the wellbore at the bottom to fill the annulus up to a desired level). The sensor module can allow for logging of the well during the trip in the well, while cement is being pushed into the wellbore annulus. The sensor module, after separation from the top dart after the top dart sets into the bottom plug, can log the well during trip out, and can be extracted or lifted out of the wellbore using a strong cable attached to the sensor module. The cable can provide power to the sensor module if batteries are not desired or are insufficient for providing the necessary power over the duration that is required. The cable may provide electrically wired telemetry or fiber optic telemetry to the surface wellhead. The cable can be fed through the wellhead and to the plug as it descends the wellbore. This is an example of "logging while cementing." Well logging data can be obtained early in the well completion process. Additionally, the well trip in and out time can be reduced compared to a dedicated log since the cement top dart is already tripping in, and is capable of carrying logging sensors.

The logging system can employ measurements of gamma rays, magnetic field dip angle, acoustic bond long, electromagnetics and RF, waterflood, NMR, gravity, chemical sensors including spectroscopy and ICE™ system data, pressure, temperature, etc. The sensor can measure during the trip down the wellbore and provide data as "measurement while cementing." This system may also allow for a free trip down the wellbore. No dedicated trip in and trip out may be necessary. The sensor module, once extracted or while measuring, can provide log data very early in the well completion process, and can provide information for remedying well completion problems and for allocation of resources (people, equipment, etc.) early in the well completion process. A dedicated log run is expensive and involves downtime on a well, which is expensive. Additionally, the wellbore does not have to be opened to insert a well logging tool to reduce well log risks.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a schematic diagram of a well system 100 for making measurements during a run-in-hole configuration in connection with a cementing operation according to one example of the present disclosure. The well system 100 can include a wellbore 102 with a casing string 104 extending from the surface 106 through the wellbore 102. A blowout preventer 107 ("BOP") can be positioned above a wellhead 109 at the surface 106. The wellbore 102 extends through various earth strata and may have a substantially vertical section 108. In some aspects, the wellbore 102 can also include a substantially horizontal section. The casing string 104 includes multiple casing tubes 110 coupled together end-to-end by casing collars 112. In some aspects, the casing tubes 110 are approximately thirty feet in length. The substantially vertical section 108 may extend through a hydrocarbon bearing subterranean formation 114.

A cementing tool, for example a cement plug 116 can be positioned downhole in the casing string 104. The cement plug 116 can be an upper cement plug, or top dart, that is inserted into the casing string 104 after a desired amount of cement 117 has been injected into the casing string 104. The cement plug 116 can be forced downhole by the injection of displacement fluid from the surface 106. A lower cement plug can be positioned below the cement 117 and can be forced downhole until it rests on a floating collar at the bottom of the casing string 104. The cement plug 116 can be forced downhole until it contacts the lower cement plug. The cement plug 116 can force the cement 117 downhole until it ruptures the lower cement plug and is forced out of a shoe of the casing string 104. The cement 117 can flow out of the casing string 104 and into the annulus 119 of the wellbore 102. Knowing the position of the cement plug 116 within the wellbore 102 can prevent errors in the cementing process and can increase the integrity of the well.

The cement plug 116 can be coupled to a sensor module 121 that can include a detachment mechanism 118 and a transceiver and sensor 120. The sensor module 121 can communicatively couple to a processing device 124 positioned at the surface 106 of the wellbore 102 via a communication medium that is a cable 122. The cable 122 can transport signals between the transceiver and sensor 120 and the processing device 124. The cable 122 may also provide power to the sensor module 121. In some examples, the cable 122 includes a fiber optic cable inside a housing to protect the fiber optic cable from the wellbore environment.

The sensor module 121 can make measurements in a run-in-hole configuration (i.e., while the sensor module 121 is being ran downhole, such as substantially contemporaneous with cement being pumped downhole). FIG. 1 shows the sensor module 121 in a run-in-hole configuration. In some examples, the sensor module 121 can generate a voltage in response to a change in a surrounding magnetic field. For example, the sensor module 121 can be a magnetic pickup coil, a piezoelectric sensor, or other suitable device. In the case of a magnetic pickup coil that includes a permanent magnet, with an associated magnetic field, and with a coil wrapped around it, the casing tubes 110 can each alter the magnetic field. Each casing collar 112 can alter the magnetic field that is different from the magnetic field as altered by the casing tubes 110 joined by the casing collar 112. The change in the magnetic field between the casing collars 112 and the casing tubes 110 can be detected by the magnetic pickup coil. The magnetic pickup coil can generate a voltage in response to the change in the surrounding magnetic field when the magnetic pickup coil passes a casing collar 112. The voltage generated by the magnetic pickup coil can be in proportion to the velocity of the sensor module 121 as it travels past the casing collar 112. In some aspects, sensor module 121 can travel between approximately 10 feet per second and approximately 30 feet per second.

The transceiver and sensor 120 can include a light source, for example an LED. The voltage generated by the magnetic pickup coil can momentarily energize the LED coupled to the magnetic pickup coil. The LED can generate a pulse of light (e.g., an optical signal) in response to the voltage generated by the magnetic pickup coil. The LED can transmit the pulse of light to the processing device 124 positioned at the surface 106. In some aspects, the LED can operate at a 1300 nm wavelength which can minimize Rayleigh backscatter transmission power losses and hydrogen-induced and bend-induced optical power losses in optical fibers. In some aspects, high-speed laser diode or other optical sources can be used in place of the LED and various other optical wavelengths can be used. For example, wavelengths from about 850 nm to 2100 nm can make use of the optical low-loss transmission wavelength bands in ordinary fused silica multimode and single mode optical fibers.

The drive circuit of the LED can use a minimum voltage that is generated by the magnetic pickup coil to complete the circuit and generate the pulse of light. In some aspects, the drive circuit of the LED can be biased with energy from a battery or other energy source. The biased drive circuit of the LED can require less voltage to be induced in the magnetic pickup coil to complete the circuit and generate the pulse of light or to allow linear modulation about the bias level light emitted by the optical source. The biased drive circuit of the LED can allow small changes in the magnetic field sensed by the magnetic pickup coil to generate a sufficient voltage to energize the LED. In some aspects, the biased drive circuit of the LED can allow the magnetic pickup coil traveling at a low velocity past a casing collar 112 to generate enough voltage to complete the circuit of the LED and emit a pulse of light or modulate the LED optical source about its bias level. A light source can be positioned proximate to the surface 106 and can transmit an optical signal downhole to determine the location of a casing collar 112 within the casing string 104.

The pulse of light generated by the LED can be transmitted, using the cable 122 that is a fiber optic cable, to the processing device 124 positioned at the surface 106. The processing device 124 can include an optical receiver, for example a photodetector, that can convert the optical signal into electricity. In some aspects, the processing device 124 can count the number of pulses of light received via the cable 122. The number of light pulses received by the processing device 124 can indicate the number of casing collars 112 that the sensor module 121 and cement plug 116 have passed. The wellbore 102 can be mapped at the surface based on the number of casing tubes 110 positioned within the wellbore 102 and their respective lengths. The number of casing collars 112 that the cement plug 116 has passed can indicate the position of the cement plug 116 within the wellbore 102. In some aspects, the processing device 124 can transmit information to the sensor module 121 via the cable 122.

The processing device 124 can also (or alternatively) be communicatively coupled to a computing device 128 located away from the wellbore 102 by a communication link 130. The communication link 130 is a wireless communication link. The communication link 130 can include wireless interfaces such as IEEE 802.11, Bluetooth, or radio interfaces for accessing cellular telephone networks (e.g., transceiver/antenna for accessing a CDMA, GSM, UMTS, or other mobile communications network). In other aspects, the communication link 130 may be wired. A wired communication link can include interfaces such as Ethernet, USB, IEEE 1394, or a fiber optic interface. The processing device 124 can transmit information related to the optical signal, for example but not limited to the light pulse count, the time the light pulse arrived, or other information, to the computing device 128. In some aspects, the processing device 124 can be coupled to a transmitter that communicates with the computing device 128.

The cable 122 that transmits the light pulse to from the sensor module 121 to the processing device 124 can be a fiber cable in a housing, such as armor. The armored fiber can include a fiber core, a cladding, and an outer buffer. The inclusion of the outer buffer can increase the diameter of the fiber optic cable. The cable 122 can be a multi-mode or single-mode optical fiber. The cable 122 can include one or more optical fibers.

Figure 2:
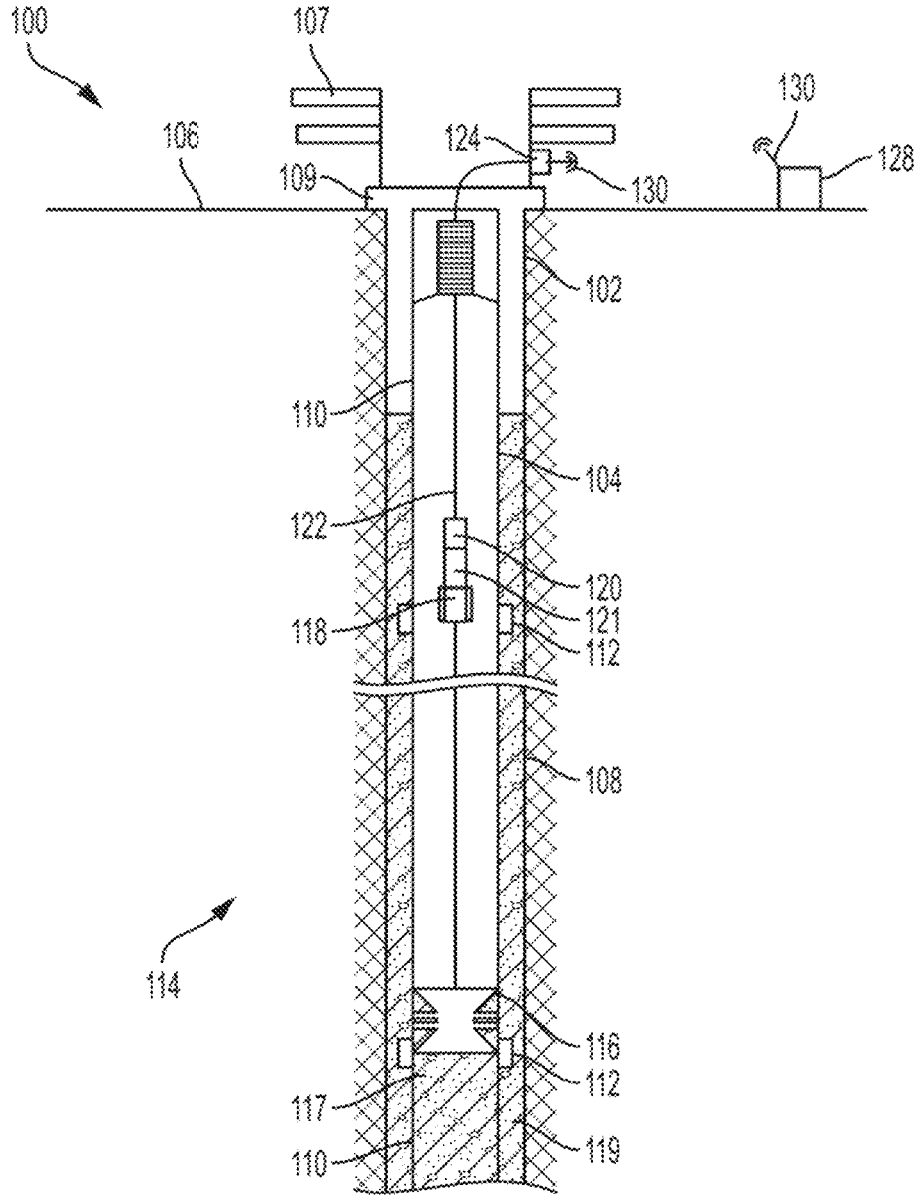
FIG. 2 is a schematic diagram of the well system of FIG. 1 for a senor module to make measurements during a come-out-hole configuration according to one example of the present disclosure.

The detachment mechanism 118 can be coupled via a lead line 139 to the cement plug 116 to releasable couple the sensor module 121 to the cement plug 116. The detachment mechanism 118 can release the sensor module 121 after a pre-set time has elapsed, or in response to a command from the processing device 124, from the cement plug 116. And the sensor module 121 can be retrieved from the wellbore 102 in a come-out-of-hole configuration by which the sensor module 121 moves uphole by drawing the cable 122 and the sensor module 121 can make measurements while being retrieved from the wellbore 102. FIG. 2 shows the sensor module 121 released from the cement plug and being retrieved from the wellbore 102. The sensor module 121 can include the coil or another measurement device that can measure the top of the cement in the annulus as the sensor module 121 is retrieved from the wellbore 102. The sensor module 121 can be released from the cement plug 116 and retrieved subsequent to the cement in the annulus curing. The top of cement measurement can be transmitted to the processing device 124, or stored in the sensor module 121 and retrieved subsequent to being removed from the wellbore 102, for a cement bond log.

The detachment mechanism 118 can include one or more features by which to release the sensor module 121 from the cement plug 116. In one example, the detachment mechanism 118 includes a dissolvable material, such as epoxy resin, a fiberglass, or another plastic. The dissolvable material can dissolve at a known rate while in a wellbore environment and release the sensor module 121 from the cement plug 116. The dissolvable material can be selected to dissolve subsequent to the cement in the annulus curing. In another example, the detachment mechanism 118 can include a latch that is controlled by a controller in the sensor module 121. The controller can include a timer or respond to a command from the processing device 124 to cause the latch to open and release the sensor module 121 from the cement plug 116. By releasing the sensor module 121 from the cement plug 116, different measurements can be taken by the sensor module 121 on a single trip, without requiring multiple trips to obtain the same information.

Figure 3:
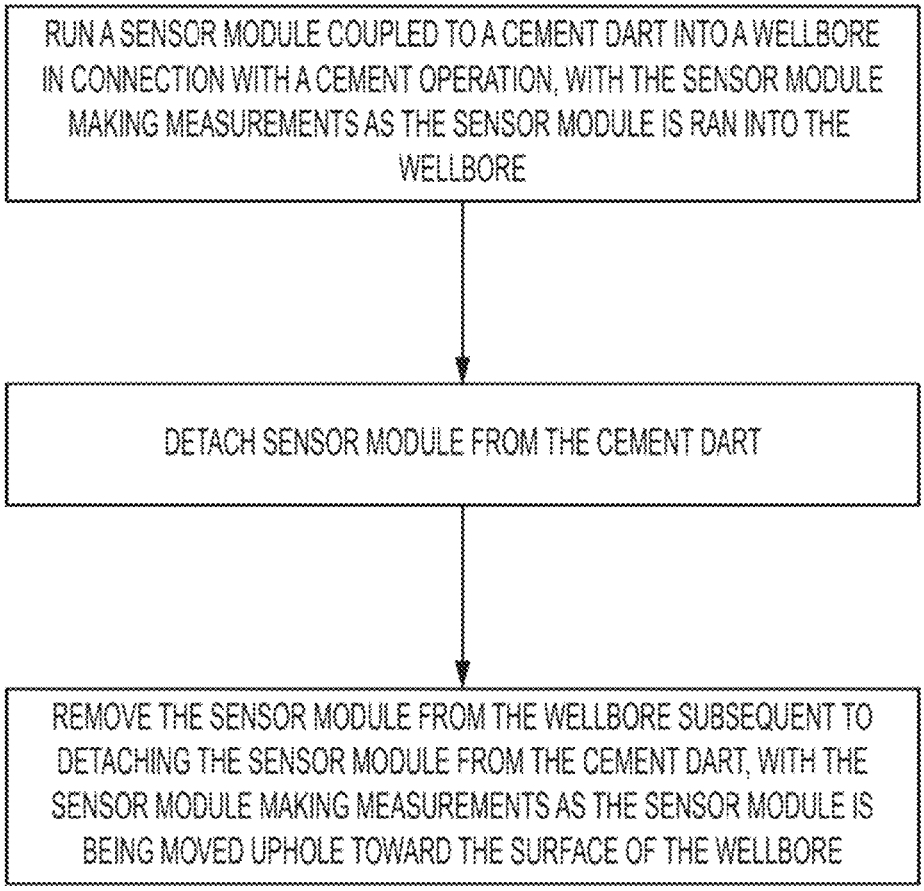
FIG. 3 is a flow chart of a process for a sensor module making multiple measurements via a single trip into and out of the wellbore according to one example of the present disclosure.

FIG. 3 is a flow chart of a process for a sensor module making multiple measurements via a single trip into and out of the wellbore according to one example of the present disclosure.

In block 302, a sensor module coupled to a cement dart (or plug) is ran into a wellbore in connection with a cement operation. The sensor module can be ran downhole by pressure or another operation pushing the cement dart into the wellbore until the cement dart, which can be a top dart, reaches the bottom dart of the cement operation. As the sensor module is ran downhole, the sensor module can make measurements, such as collar location measurements, and transmit the measurements via a communication medium to a processing device, which can be located at or near the surface of the wellbore.

In block 304, the sensor module is detached from the cement dart. The sensor module can include a detachment mechanism that can detach the sensor module from the cement dart after a specified amount of time or in response to a command from the processing device.

In block 306, the sensor module is removed from the wellbore subsequent to detaching from the cement dart. The sensor module can make measurements while being retrieved from the wellbore by being moved uphole toward a surface of the wellbore.

In some aspects, a sensor module is provided according to one or more of the following examples:

Example 1 is a system comprising: a sensor module that is detachable from a cement dart; and a processing device for communicatively coupling to the sensor module to receive measurements made by the sensor module in a run-in-hole configuration prior to detaching from the cement dart and in a come-out-of-hole configuration subsequent to detaching from the cement dart in a wellbore.

Example 2 is the system of example 1, further comprising a fiber optic cable disposed within a cable structure to communicatively couple the sensor module to the processing device.

Example 3 is the system of example 1, wherein the sensor module comprises: a transceiver to transmit data to the processing device and to receive commands from the processing device; and a detachment mechanism to couple the sensor module to the cement dart that is a top dart for a cement operation in the wellbore.

Example 4 is the system of example 3, wherein the detachment mechanism is a material that is dissolvable in an environment of the wellbore.

Example 5 is the system of example 3, wherein the detachment mechanism is a latch that is releasable by a controller in the sensor module in response to a pre-set amount of time expiring or is releasable by the controller in response to a signal from the processing device.

Example 6 is the system of example 1, wherein the measurements in the run-in-hole configuration include identifying a location of a casing collar in the wellbore and the measurements in the come-out-of-hole configuration include identifying a location of a top of cement in the wellbore for a cement bond log.

Example 7 is the system of example 6, wherein the sensor module is adapted to identify the location of the casing collar and the location of the top of cement subsequent to cement in an annulus of the wellbore curing, in a single trip into and out of the wellbore.

Example 8 is the system of example 6, wherein the sensor module is adapted to be in the run-in-hole configuration as cement is being pumped into the wellbore.

Example 9 is a sensor module comprising: a detachment mechanism to detachably couple to a cement dart; a sensor to make measurements in a run-in-hole configuration prior to detaching from the cement dart and in a come-out-of-hole configuration subsequent to detaching from the cement dart in a wellbore; and a transceiver to transmit the measurements to a processing device via a communication medium and to receive commands from the processing device via the communication medium.

Example 10 is the sensor module of example 9, wherein the communication medium is a fiber optic cable disposed within a cable structure.

Example 11 is the sensor module of example 9, wherein the cement dart is a top dart for a cement operation in the wellbore.

Example 12 is the sensor module of example 9, wherein the detachment mechanism is a material that is dissolvable in an environment of the wellbore.

Example 13 is the sensor module of example 9, further comprising a controller, wherein the detachment mechanism is a latch that is releasable by the controller in response to a pre-set amount of time expiring or is releasable by the controller in response to a signal from the processing device.

Example 14 is the sensor module of example 9, wherein the measurements in the run-in-hole configuration include identifying a location of a casing collar in the wellbore and the measurements in the come-out-of-hole configuration include identifying a location of a top of cement in the wellbore for a cement bond log.

Example 15 is the sensor module of example 14, wherein the sensor module is adapted to identify the location of the casing collar and the location of the top of cement subsequent to the cement curing, in a single trip into and out of the wellbore.

Example 16 is the sensor module of example 14, wherein the sensor module is adapted to be in the run-in-hole configuration as cement is being pumped into the wellbore.

Example 17 is a method comprising: running a sensor module coupled to a cement dart into a wellbore in connection with a cement operation, the sensor module making measurements as the sensor module is ran into the wellbore, and communicating the measurements to a processing device via a communication medium; detaching the sensor module from the cement dart; and removing the sensor module from the wellbore subsequent to detaching the sensor module from the cement dart, the sensor module making measurements as the sensor module is being moved uphole toward a surface of the wellbore.

Example 18 is the method of example 17, wherein the communication medium is a fiber optic cable disposed within a cable structure.

Example 19 is the method of example 17, wherein the measurements as the sensor module is ran into the wellbore include identifying a location of a casing collar in the wellbore and the measurements as the sensor module is being moved uphole include identifying a location of a top of cement in the wellbore for a cement bond log.

Example 20 is the method of example 19, wherein the sensor module identifies the location of the casing collar and the location of the top of cement subsequent to the cement curing, in a single trip into and out of the wellbore.

The foregoing description of certain aspects, including illustrated aspects, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a sensor module configured to detachably couple, in a run-in-hole configuration, to a cement dart in a wellbore in connection with a cement operation, the sensor module being communicatively couplable to a fiber optic cable for making measurements as the sensor module is ran into the wellbore and communicating the measurements to a processing device via the fiber optic cable; and the processing device for receiving come-out-of-hole measurements from the sensor module via the fiber optic cable and subsequent to the sensor module detaching from the cement dart as the sensor module is being moved uphole toward a surface of the wellbore.

2. The system of claim 1, wherein the fiber optic cable is disposed within a cable to communicatively couple the sensor module to the processing device.

3. The system of claim 1, wherein the sensor module comprises:

a transceiver to transmit data to the processing device and to receive commands from the processing device; and a detachment mechanism to couple the sensor module to the cement dart that is a top dart for a cement operation in the wellbore.

4. The system of claim 3, wherein the detachment mechanism is a material that is dissolvable in an environment of the wellbore.

5. The system of claim 3, wherein the detachment mechanism is releasable by a controller in the sensor module in response to a pre-set amount of time expiring or is releasable by the controller in response to a signal from the processing device.

6. The system of claim 1, wherein the measurements in the run-in-hole configuration include identifying a location of a casing collar in the wellbore and the measurements in a come-out-of-hole configuration include identifying a location of a top of cement in the wellbore for a cement bond log.

7. The system of claim 6, wherein the sensor module is adapted to identify the location of the casing collar and the location of the top of cement subsequent to cement in an annulus of the wellbore curing, in a single trip into and out of the wellbore.

8. The system of claim 6, wherein the sensor module is adapted to be in the run-in-hole configuration as cement is being pumped into the wellbore.

9. A sensor module comprising:

a detachment mechanism to detachably couple to a cement dart;

a sensor communicatively couplable to a fiber optic cable for making measurements in a run-in-hole configuration prior to detaching from the cement dart and for making measurements that are transmittable uphole by the fiber optic cable while the sensor module is being moved uphole in a come-out-of-hole configuration subsequent to detaching from the cement dart in a wellbore; and a transceiver to transmit the measurements to a processing device via the fiber optic cable and to receive commands from the processing device via the fiber optic cable.

10. The sensor module of claim 9, wherein the cement dart is a top dart for a cement operation in the wellbore.

11. The sensor module of claim 9, wherein the detachment mechanism is a material that is dissolvable in an environment of the wellbore.

12. The sensor module of claim 9, further comprising a controller, wherein the detachment mechanism is releasable by the controller in response to a pre-set amount of time expiring or is releasable by the controller in response to a signal from the processing device.

13. The sensor module of claim 9, wherein the measurements in the run-in-hole configuration include identifying a location of a casing collar in the wellbore and the measurements in the come-out-of-hole configuration include identifying a location of a top of cement in the wellbore for a cement bond log.

14. The sensor module of claim 13, wherein the sensor module is adapted to identify the location of the casing collar and the location of the top of cement subsequent to the cement curing, in a single trip into and out of the wellbore.

15. The sensor module of claim 13, wherein the sensor module is adapted to be in the run-in-hole configuration as cement is being pumped into the wellbore.

16. A method comprising:

running a sensor module coupled to a cement dart into a wellbore in connection with a cement operation, the sensor module communicatively coupled to a fiber optic cable for making measurements as the sensor module is ran into the wellbore, and communicating the measurements to a processing device via the fiber optic cable;

detaching the sensor module from the cement dart; and removing the sensor module from the wellbore subsequent to detaching the sensor module from the cement dart, the sensor module making measurements and communicating the measurements uphole via the fiber optic cable as the sensor module is being moved uphole toward a surface of the wellbore.

17. The method of claim 16, wherein the fiber optic cable is disposed within a cable to communicatively couple the sensor module to the processing device.

18. The method of claim 16, wherein the measurements as the sensor module is ran into the wellbore include identifying a location of a casing collar in the wellbore and the measurements as the sensor module is being moved uphole include identifying a location of a top of cement in the wellbore for a cement bond log.

19. The method of claim 18, wherein the sensor module identifies the location of the casing collar and the location of the top of cement subsequent to the cement curing, in a single trip into and out of the wellbore.

* * * * *